US008667745B1

(12) United States Patent
May

(10) Patent No.: US 8,667,745 B1
(45) Date of Patent: Mar. 11, 2014

(54) MILITARY SERVICE PERSONS BURIAL MARKER ASSEMBLY

(76) Inventor: Jesse C. May, Colwich, KS (US)

( * ) Notice: Subject to any disclaimer, the term of this patent is extended or adjusted under 35 U.S.C. 154(b) by 0 days.

(21) Appl. No.: 13/537,746

(22) Filed: Jun. 29, 2012

(51) Int. Cl.
*E04H 13/00* (2006.01)

(52) U.S. Cl.
USPC ..... 52/103; 52/105

(58) Field of Classification Search
USPC ..... 52/103, 105, 128, 311.1; 40/124.5
See application file for complete search history.

(56) References Cited

U.S. PATENT DOCUMENTS 2,023,519 A * 12/1935 Durrett et al. ..... 40/620
2,148,660 A * 2/1939 Sweeney ..... 40/124.5
5,454,178 A * 10/1995 Rivard ..... 40/124.5
6,898,879 B2 * 5/2005 Regelin ..... 40/124.5
6,922,927 B1 * 8/2005 Harmon ..... 40/124.5
2010/0313492 A1 * 12/2010 Shellhouse et al. ..... 52/103

* cited by examiner

*Primary Examiner* — Andrew Triggs
(74) *Attorney, Agent, or Firm* — Kenneth H. Jack; Davis & Jack, LLC

(57) ABSTRACT

A military service persons burial marker assembly having an upper plaque having front and rear faces; upper indicia fixedly attached to or formed wholly with the upper plaque's front face, the upper indicia commemorating the service person; a bracket cantilevering rearwardly from the upper plaque; a lower plaque having a front face; lower indicia fixedly attached to or formed wholly with the lower plaque's front face, the lower indicia further commemorating the service person; a loop fixedly attached to and extending rearwardly from the lower plaque; and a hook connected operatively to the loop, the hook being adapted for engaging the bracket for resisting downward movements of the lower plaque with respect to the upper plaque.

9 Claims, 3 Drawing Sheets

MILITARY SERVICE PERSONS BURIAL MARKER ASSEMBLY

FIELD OF THE INVENTION

This invention relates to grave or burial site accoutrements, accessories, auxiliary components, and the like. More particularly, the instant invention is related to markers which include indicia commemorating deceased persons buried at such sites.

BACKGROUND OF THE INVENTION

Ground stake mounted commemorative plaques are commonly displayed at military service persons burial or grave sites. Such plaques commonly comprise a rectangular or oval plate composed of brass or aluminum. Such plaques typically have a front indicia displaying surface and a rear ground stake and flag mounting surface. Indicia appearing upon the front sides of such plates commonly comprise bold relief insignia or graphic symbols which represent the service person's branch of military service. A small amount of bold relief text conveying information such as the service person's status upon retirement or the service person's particular unit or division of service may also appear upon the plaque.

Drawbacks or deficiencies of such burial site plaques are noted and are attributable to the facts that they are typically only minimally or marginally individualized for use at the burial site of a particular deceased military service person, and they are capable of displaying only a small amount of informational text. The instant invention solves or ameliorates the problems and deficiencies noted above by providing an assembly which incorporates upper and lower plaques and which associates with those plaques useful, novel and unique interconnecting structures.

BRIEF SUMMARY OF THE INVENTION

The instant inventive military service persons burial marker assembly preferably comprises an upper plaque or plate having front and rear faces. The upper plaque may suitably be composed of plastic. However, for purposes of appearance and durability, the upper plaque is preferably composed of cast aluminum. Alternatively, the upper plaque may be composed of brass or bronze. Suitable peripheral geometric configurations of the upper plaque include circular, oval, and rectangular shapes.

Further structural components of the instant inventive assembly comprise upper indicia which are fixedly attached to or are formed wholly with the upper plaque's front face. The upper indicia may include graphic images signifying a particular deceased service person's branch of military service and/or text indicating the status or rank of service person, or designating a unit or division of service. In a preferred embodiment, such upper indicia are formed wholly with the upper plaque to appear as integrally molded bold relief images, numbers, or letters. Alternatively, the upper indicia element may comprise printed or painted images and text, decal applications of images and text, or engraved or scribed images or text. In the preferred embodiment, the upper indicia components are specially configured or textually arranged to be commemorative of a particular deceased military service person.

A further structural component of the inventive assembly comprises a ground stake mounting bracket. In a preferred embodiment, such bracket is fixedly attached to and cantilevers rearwardly from the upper plaque's rear face. Such bracket may suitably comprise an arm or flange whose proximal end forms a wholly formed joint with the upper plaque's rear face, and whose distal end extends rearwardly therefrom and incorporates a stake fastening component.

The instant inventive assembly preferably further comprises a lower plaque having a front face which displays lower indicia, the front face preferably having a vertical upper section and a forwardly canted lower section. In a preferred embodiment, the lower indicia comprise an adhesively mounted plate which is engraved to include further commemorative text such as the name of the service person, the birth and death dates of the service person, and the service person's dates of military service. Suitably, such further commemorating indicia may be printed, scribed, or engraved directly upon the front face of the lower plaque. In a preferred embodiment, the lower plaque is composed of aluminum. Suitably, the lower plaque may comprise durable plastic, brass, or bronze.

A further structural component of the instant inventive assembly comprises an eye or loop member which is preferably fixedly attached to and extends rearwardly from the upper end of the lower plaque. In the preferred embodiment, the opening of the loop member is sized to facilitate through passage of the upper end of a ground stake. Preferably, the loop member is formed wholly with the lower plaque and extends substantially rigidly therefrom.

The instant inventive burial marker assembly preferably further comprises first stop means which are connected operatively to the loop member. Such means are preferably specially configured and adapted for engaging the upper plaque's bracket for resisting downward movement of the lower plaque with respect to the upper plaque. In a preferred embodiment, the first stop means comprise a hook member having an upwardly extending base and a tail which extends forwardly from the base's upper end. The base's lower end is preferably fixedly attached to or formed wholly with the loop's distal end.

Further structural components of the instant inventive assembly comprise a ground stake and ground stake mounting means. The ground stake mounting means are preferably adapted for, upon engagement of the first stop means with the upper plaque's bracket (e.g., via placement of the hook's tail thereover) and upon an upward extension of the ground stake through the lower plaque's loop, fixedly (and preferably removably) attaching the stake's upper end to the bracket. Such mounting means preferably comprise a helically threaded lug or pin and socket combination wherein the socket opens at the bracket's distal end, and wherein the lug extends upwardly from the ground stake's upper end. Other commonly known mounting means such as pressure fitted joints and adhesively bonded joints may be suitably substituted and alternatively utilized.

In use of the instant inventive military service persons burial marker assembly, the lower plaque may be conveniently attached to and detached from the upper plaque and ground stake combination for display of the lower plaque's lower face immediately below the upper plaque's lower end, and for enhancing and supplementing the commemorative indicia which may be viewed by visitors at the service person's burial site.

As used herein, the term "military service person" is intended to be inclusive of fire and police men and women, and EMS personnel.

Accordingly, objects of the instant invention include the provision of a military service persons burial marker assembly which incorporates structures as described above, and which arranges those structures in relation to each other in the manners described above for the performance of the beneficial functions and securing and achieving the benefits described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
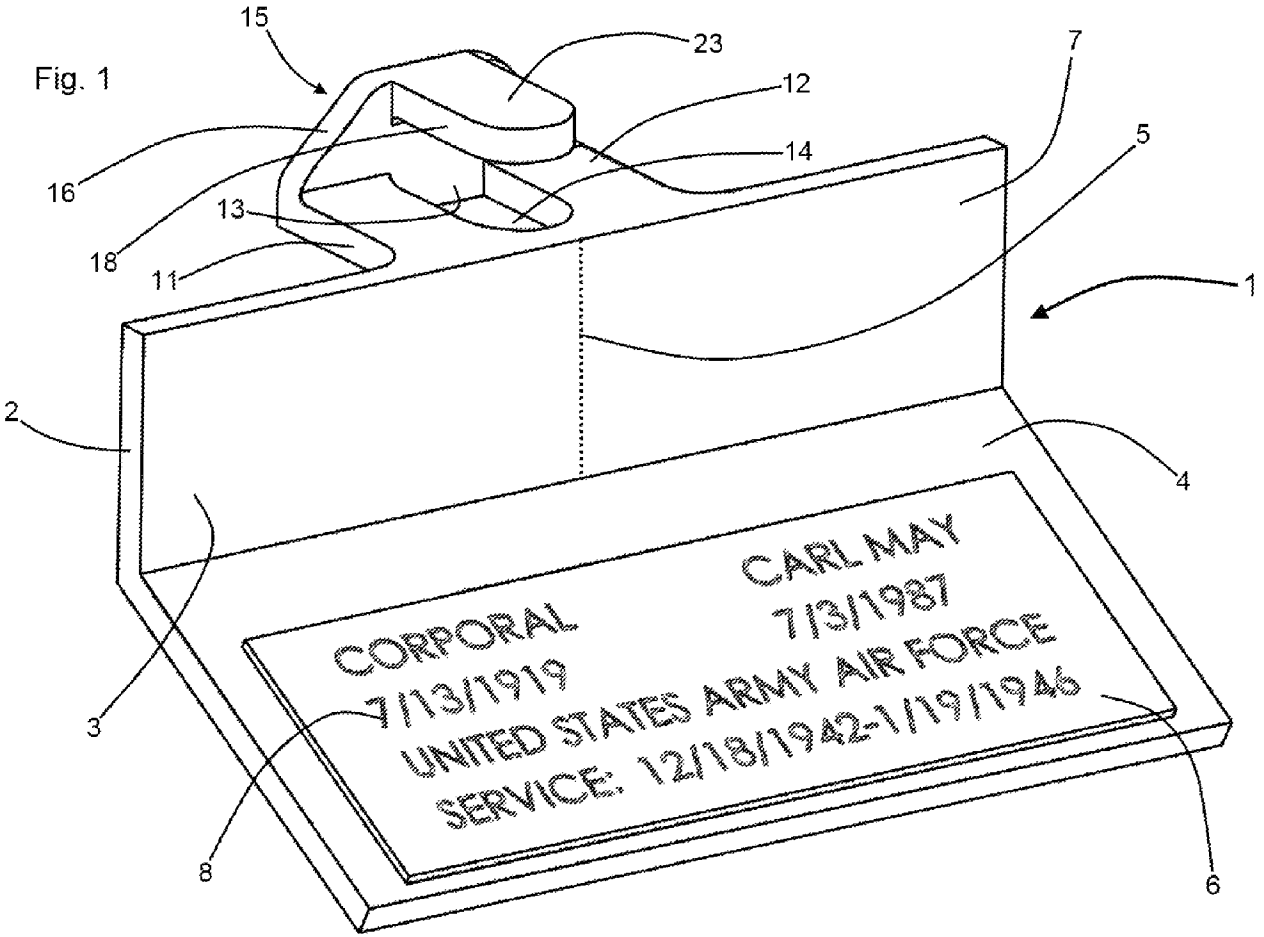
FIG. 1 is a perspective view of a lower plaque component of the instant inventive military service persons burial marker assembly.
Figure 2:
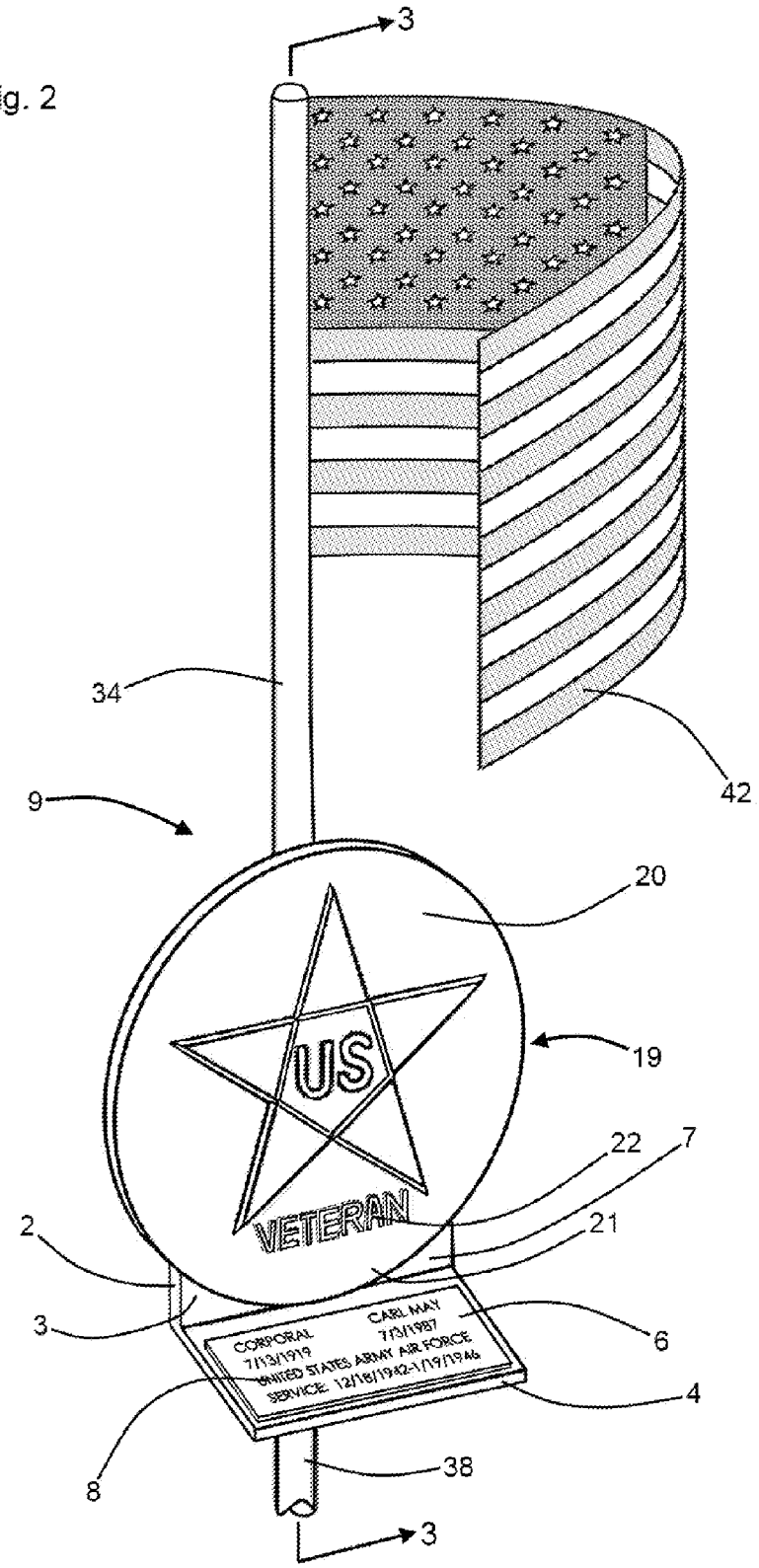
FIG. 2 is a partial perspective view of the instant inventive military service persons burial marker assembly, the view incorporating the lower plaque component of FIG. 1.
Figure 3:
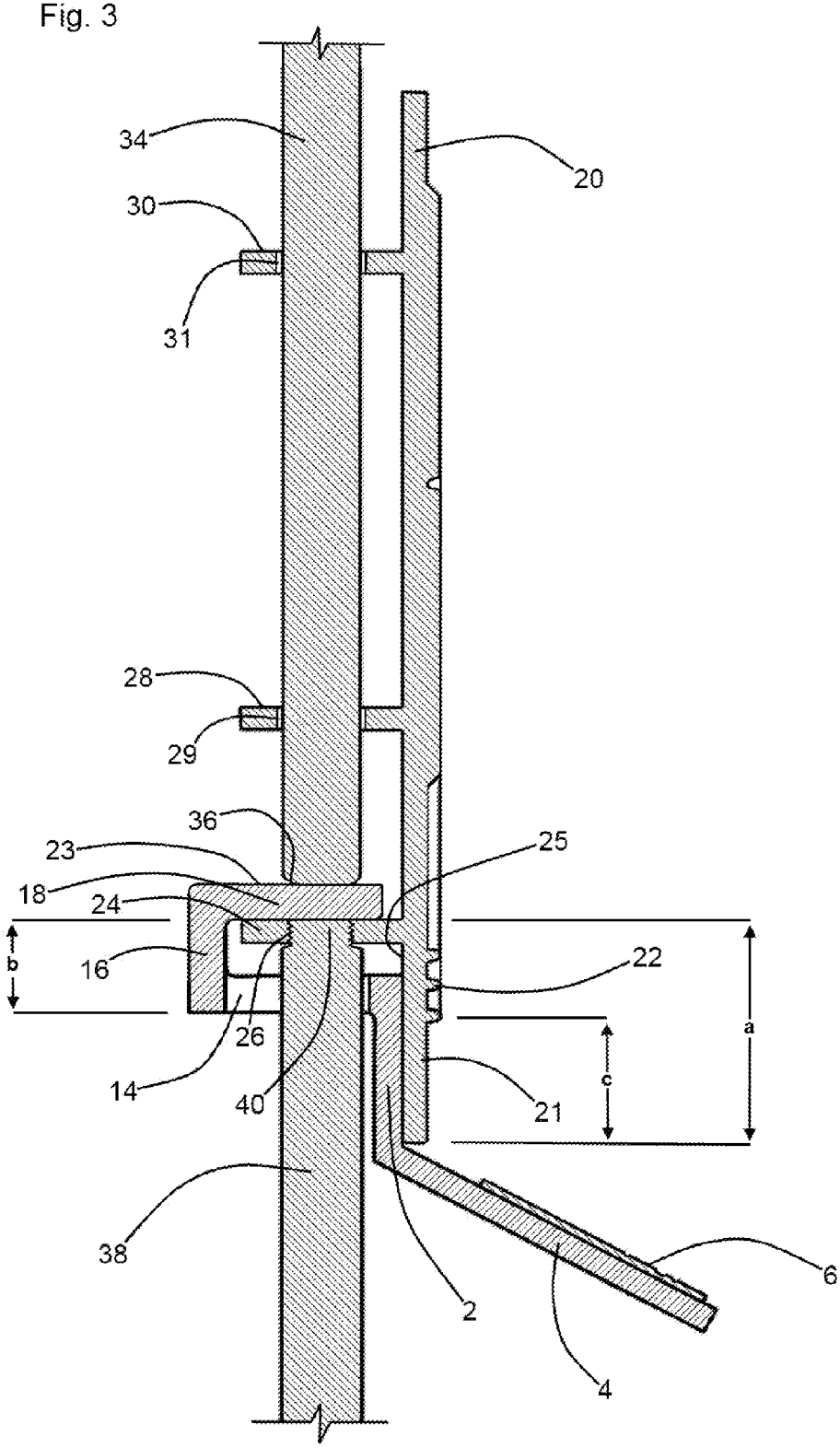
FIG. 3 is a partial sectional view as indicated in FIG. 2.

Referring now to the drawings, and in particular simultaneously to FIGS. 1 and 2, the instant inventive military service persons burial marker is referred to generally by Reference Arrow 9. The assembly 9 comprises an upper plaque which is referred to generally by Reference Arrow 19. Referring further to FIG. 3, the upper plaque 19 has rearwardly cantilevering bracket 24, an upper plaque section 20 which extends generally upwardly from the proximal end of bracket 24, and a lower plaque segment 21 which extends generally downwardly from the proximal end of bracket 24. Bold relief military service person commemorating indicia 22 preferably appears upon the front face of the upper plaque 19, and a plurality of flag staff receiving and stabilizing loops 28 and 30 are preferably fixedly attached to and, similarly with bracket 24, cantilever rearwardly from the rearward face of the upper plaque 19. Vertically opening eyes 29 and 31 within loops 28 and 30 are preferably fitted for receiving and holding the flag staff 34 of flag staff and flag combination 34, 42.

Referring simultaneously to all figures, a lower plaque component of the instant inventive assembly is referred to generally by Reference Arrow 1, the lower plaque 1 preferably having a substantially vertically oriented upper segment 2 and a forwardly canted lower segment 4. Service member commemorating indicia 8, preferably of the type which is engraved upon an adhesively attached plate 6, is displayed upon a lower forwardly angled segment 4 of the front face of lower plaque 1.

A loop is preferably fixedly attached to and extends rearwardly from the upper end of the lower plaque 1, such loop forming and defining an eye or opening 14. The loop preferably includes stake head bracketing members selected among sections 11, 12, and 13, such loop preferably including each of such sections. Suitably, though less desirably, the loop component may comprise as few as a pair of sections selected among sections 11, 12, and 13. Preferably, the eye or opening 14 is fitted for receipt of and vertical through passage of the upper end of a ground stake 38.

First stop means are preferably provided, such means being referred to generally by Reference Arrow 15. In the depicted preferred embodiment, such stop means 15 comprise a hook member which includes an upwardly extending base section 16 and a forwardly extending tail section 18. Upon placement of the tail section 18 directly over the upper surface of bracket 24 as depicted in FIG. 3, the first stop means 16, 18 advantageously resists downward movements of the lower plaque 1 with respect to the upper plaque 19.

Referring to all figures, and with particular reference to FIG. 3, the vertical length or dimension of the lower segment 21 of the upper plaque 19 is denoted by dimension "a", the vertical dimension or length of the upward extension of the hook's base 16 from loop 12 is denoted by dimension "b", and the vertical dimension or length of the upper segment 2 of the lower plaque is denoted by dimension "c". As can be seen in FIG. 3, segment 2, segment 21, and base 16 are sized with respect to each other so that the dimension "a" of the lower segment 21 is less than or equal to the sum of dimensions "b" and "c" of the hook base 16 and the lower plaque upper segment 2. Such relative sizing of components advantageously allows the lower segment 4 of the lower plaque 1 to angularly cant forwardly from beneath the extreme lower end of the upper plaque 19, such orientations and respective sizings of structures advantageously allowing commemorative indicia 8 displayed upon the lower plaque 1 to be easily viewed and read by burial site visitors.

Referring simultaneously to FIGS. 1 and 3, it may be seen that the hook configuration of the first slide stop 16, 18 forms a level or horizontal land 23 at the upper surface of the tail 18. Such configuration advantageously allows the tail 18 to further function (in addition to the first stopping means function) as a pedestal for supporting the lower end 36 of the flag staff 34.

Referring in particular to FIG. 3, mounting means are preferably provided for interconnecting the upper end of ground stake 38 with bracket 24, such means preferably comprising a helically threaded lug and socket joint, the lug being denoted by Reference Numeral 40, and mating helical threads (residing both upon the annular outer periphery of lug 40, and upon the annular inner periphery of a socket opening of bracket 24) being denoted by Reference Numeral 26. Upon upward passage of the upper end of ground stake 38 through loop eye 14, the lug 40 may securely threadedly engage and removably attach to bracket 24. Such attachment securely supports upper plaque 19 upon stake 38, while allowing secure suspension of the lower plaque 1 from hook 16, 18, and while facilitating secure support of the flag and flag staff combination 34, 42 via the pedestal configuration of tail 18.

Referring in particular to FIG. 1, a vertical dotted line 5 is drawn, such dotted line representing a lower plaque lateral midline. The lower plaque's upper segment 2 preferably forms and presents stop members 3 and 7 which respectively extend laterally and oppositely laterally from the lateral midline 5. Upon mounting of the lower plaque 1 in the manner depicted in FIGS. 2 and 3, the forward face of the upper segment 2 of the lower plaque 1 preferably directly abuts the rearward face 25 of the lower segment 21 of the upper plaque 19. Upon such abutting contact, the lateral and oppositely laterally stop members 3 and 7 advantageously function as second stop means which resist any rotation about a vertical axis of the lower plaque 1 with respect to the upper plaque 19. Accordingly, structural elements 2, 3, 7, 12, 16, and 18 of the lower plaque 1 advantageously function for resisting both vertical motion and rotational motion of the lower plaque 1 with respect to the upper plaque 19.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A service person's burial marker assembly comprising:
(a) an upper plaque having front and rear faces;
(b) upper indicia fixedly attached to or formed wholly with the upper plaque's front face, the upper indicia commemorating the service person;
(c) a bracket comprising a cantilevering arm, the cantilevering arm being fixedly attached to and extending rearwardly from the upper plaque;
(d) a lower plaque having a front face;
(e) lower indicia fixedly attached to or formed wholly with the lower plaque, the lower indicia further commemorating the service person;
(f) a loop fixedly attached to and extending rearwardly from the lower plaque; and
(g) first stop means connected operatively to the loop, the first stop means being adapted for downwardly engaging the cantilevering arm for resisting downward movements of the lower plaque with respect to the upper plaque, wherein the first stop means comprise a hook having a tail, and wherein the first stop means' downward engagement of the cantilevering arm comprises an overlying positioning of the hook's tail with respect to the cantilevering arm and comprises underlying support of the hook's tail by the cantilevering arm.

2. The assembly of claim 1 comprising a ground stake having an upper end, and further comprising mounting means adapted for, upon an extension of the ground stake's upper end through the loop, interconnecting the stake and the bracket.

3. The assembly of claim 2 wherein the mounting means comprises a helically threaded lug and socket joint.

4. A service person's burial marker assembly comprising:
(a) an upper plaque having front and rear faces;
(b) upper indicia fixedly attached to or formed wholly with the upper plaque's front face, the upper indicia commemorating the service person;
(c) a bracket fixedly attached to and extending rearwardly from the upper plaque;
(d) a lower plaque having a front face;
(e) lower indicia fixedly attached to or formed wholly with the lower plaque, the lower indicia further commemorating the service person;
(f) a loop fixedly attached to and extending rearwardly from the lower plaque; and
(g) first stop means connected operatively to the loop, the first stop means being adapted for engaging the bracket for resisting downward movements of the lower plaque with respect to the upper plaque; wherein the first stop means comprise a hook having base and tail sections, wherein each plaque among the upper and lower plaques has upper and lower sections, the upper plaque's upper and lower sections respectively extending upwardly and downwardly from the bracket, wherein the upper plaque's lower section has a first vertical dimension, wherein the hook's base section has a second vertical dimension, wherein the lower plaque's upper section has a third vertical dimension, and wherein the upper plaque's lower section, the hook's base section, and the lower plaque's upper section are sized so that the first vertical dimension is less than the sum of the second and third vertical dimensions.

5. The assembly of claim 4 wherein the lower plaque's lower section is forwardly canted with respect to the lower plaque's upper section.

6. The assembly of claim 5 further comprising second stop means operatively connected to the lower plaque, the second stop means being adapted for resisting rotating movements of the lower plaque with respect to the upper plaque.

7. The assembly of claim 6 wherein the lower plaque's upper section has a lateral midline, wherein said upper section comprises lateral and oppositely lateral extensions from said midline, and wherein the second stop means comprise said lateral and oppositely lateral extensions.

8. A service person's burial marker assembly comprising:
(a) an upper plaque having front and rear faces;
(b) upper indicia fixedly attached to or formed wholly with the upper plaque's front face, the upper indicia commemorating the service person;
(c) a bracket comprising a rearwardly cantilevering arm, the bracket being fixedly attached to and extending rearwardly from the upper plaque;
(d) a lower plaque having a front face;
(e) lower indicia fixedly attached to or formed wholly with the lower plaque, the lower indicia further commemorating the service person;
(f) a loop fixedly attached to and extending rearwardly from the lower plaque;
(g) first stop means connected operatively to the loop, the first stop means being adapted for engaging the bracket for resisting downward movements of the lower plaque with respect to the upper plaque;
(h) a ground stake having an upper end; and
(i) a helically threaded lug and socket joint adapted for, upon an extension of the ground stake's upper end through the loop, interconnecting the stake and the bracket; wherein the first stop means comprise a hook having a tail, wherein the tail has an upper surface, and further comprising a pedestal having a flag support land, the flag support land comprising the tail's upper surface.

9. The assembly of claim 8 comprising a plurality of second loops, each loop among the plurality of second loops extending rearwardly from the upper plaque, and further comprising a flag and flag staff assembly, said assembly's flag staff having a lower end which, upon extensions of the flag staff through the second loops, may rest against the pedestal's flag support land.

* * * * *